US006903510B2

(12) United States Patent
Ohshima et al.

(10) Patent No.: US 6,903,510 B2
(45) Date of Patent: Jun. 7, 2005

(54) ARC TUBE HAVING COMPRESSIVE STRESS AND METHOD FOR MANUFACTURE OF AN ARC TUBE

(75) Inventors: Yoshitaka Ohshima, Shizuoka (JP); Shinichi Irisawa, Shizuoka (JP); Akihiro Nagata, Shizuoka (JP); Hiroshi Goto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 78 days.

(21) Appl. No.: 09/987,172

(22) Filed: Nov. 13, 2001

(65) Prior Publication Data

US 2002/0084755 A1 Jul. 4, 2002

(30) Foreign Application Priority Data

Nov. 14, 2000 (JP) ..... P. 2000-347260

(51) Int. Cl.[7] ..... H01J 17/16; H01J 61/30

(52) U.S. Cl. ..... 313/634; 313/623; 313/636; 313/573

(58) Field of Search ..... 313/623, 634, 313/636, 318.07, 573, 317

(56) References Cited

U.S. PATENT DOCUMENTS 5,757,110 A * 5/1998 Motiduki et al. ..... 313/25
5,877,590 A 3/1999 Fukuyo et al. ..... 313/623
5,936,349 A 8/1999 Fukai et al. ..... 313/623
5,962,976 A * 10/1999 Irisawa et al. ..... 313/623
6,356,018 B1 * 3/2002 Higashimoto et al. ..... 313/623
6,368,175 B1 * 4/2002 Horiuchi et al. ..... 445/26
6,452,334 B1 * 9/2002 Ohshima et al. ..... 313/623

* cited by examiner

*Primary Examiner*—Joseph Williams
*Assistant Examiner*—Kevin Quarterman

(74) *Attorney, Agent, or Firm*—Sughrue Mion, PLLC

(57) ABSTRACT

An arc tube body 20 and a foil such as molybdenum foil 30 are joined with each other such that a compressive stress of $10^5$ N/m$^2$ or more remains at an ordinary temperature in the arc tube body 20 along a junction surface. The compressive stress is always generated on the arc tube body 20 even if a fluctuation in the stress is caused on the junction surface by the repetition of the ON/OFF of the arc tube (or a tensile stress is caused to have a very small value even if the compressive stress and the tensile stress are alternately generated). Thus, the junction strength of both members may be increased. In one embodiment, a plurality of cracks (intercrystalline cracks) may be generated on the molybdenum foil 30 by a high pressure acting during pinch seal, and quartz glass is caused to enter the cracks so that the junction strength of both members can be increased.

7 Claims, 11 Drawing Sheets

ARC TUBE HAVING COMPRESSIVE STRESS AND METHOD FOR MANUFACTURE OF AN ARC TUBE

BACKGROUND OF THE INVENTION

1. Field of the Invention

The present invention relates to an arc tube and a method for manufacturing an arc tube, and more particularly to an arc tube and a method for manufacturing an arc tube that can be used as a light source for a headlamp of a vehicle.

2. Description of the Related Art

In recent years, an arc tube has often been used as a light source of a headlamp for a vehicle because it can carry out irradiation with a high luminance. As shown in FIG. 12, an arc tube to be used in a headlamp for a vehicle generally has an arc tube body 104 formed of a glass material in which a pinch seal portion 104*b* is provided on both sides of a light emitting tube portion 104*a* forming a discharge space 102. The arc tube includes a pair of electrode assemblies 106, each having a tungsten electrode 108 and a lead wire 110 coupled and fixed to each other through a molybdenum foil 112. Each electrode assembly 106 is pinch sealed with the arc tube body 104 in each pinch seal portion 104*b*. By the pinch seal, the molybdenum foil 112 is joined with the arc tube body 104 in such a state as to be embedded in the arc tube body 104.

In a conventional arc tube as shown in FIG. 12, however, the junction strength of the molybdenum foil 112 and the arc tube body 104 is not sufficient. For this reason, the molybdenum foil 112 is easily peeled in the junction surface of the molybdenum foil 112 and the arc tube body 104 during the use of the arc tube. When such peeling is caused, a crack is generated on the arc tube body 104 from the edge of the junction surface and grows to finally generate a leakage between the discharge space 102 and an external space. Accordingly, the lifetime of a conventional arc tube is comparatively short.

Also in the conventional arc tube, a slight compressive stress remains at an ordinary temperature along the junction surface of the arc tube body and the molybdenum foil (a tensile stress remains in the molybdenum foil), and the coefficient of linear expansion of the molybdenum foil is much greater than (approximately 10 times as great as) that of the arc tube body. Therefore, when the temperature is raised by turning on the arc tube, tensile stress is generated on the arc tube body (the compressive stress is generated on the molybdenum foil). For this reason, the compressive stress and the tensile stress are alternately generated on the arc tube body by repeatedly turning on and off the arc tube. Consequently, the engagement state of the molybdenum foil and the arc tube body is broken so that the molybdenum foil easily peels.

SUMMARY OF THE INVENTION

The present invention has been made in consideration of such circumstances and has an object to provide an arc tube capable of effectively suppressing the generation of a leakage due to the peeling of a molybdenum foil, thereby prolonging the lifetime of the arc tube.

The invention attains this object by including a residual stress of a predetermined magnitude along the junction surface of a molybdenum foil and an arc tube body through pinch seal. This residual stress greatly influences the junction strength of both members. The invention also devises the magnitude required for the residual stress.

The invention provides an arc tube comprising an arc tube body formed of, for example, quartz glass, and a foil, such as a molybdenum foil, joined with the arc tube body through pinch seal. The arc tube body and the molybdenum foil are joined with each other such that a compressive stress of $10^5$ $N/m^2$ or more remains in the arc tube body along a junction surface at an ordinary temperature.

The foil may be a foil comprised of molybdenum, and may also include other components added thereto as long as molybdenum remains a principal component.

While the arc tube body and the molybdenum foil are generally joined on both sides of the light emitting tube portion through the pinch seal in the arc tube, the "junction" in the structure described above may be applied to both or either of the pinch seal portions.

In the structure described above, the arc tube according to the invention is so constituted that the molybdenum foil and the arc tube body formed of quartz glass are joined through the pinch seal, using the method of the invention, in such a state that the molybdenum foil is inserted in the arc tube body. The arc tube body and the molybdenum foil are joined with each other such that a compressive stress of $10^5$ $N/m^2$ or more remains at an ordinary temperature in the arc tube body along the junction surface.

In addition, the junction strength of the engagement of the molybdenum foil and the arc tube body can be increased by engaging both members with each other in small concavo-convex portions during light-on and light-off in order to increase the junction strength of both members.

Further, in the present invention, when the joining is carried out such that a compressive stress of $10^5$ $N/m^2$ or more remains at an ordinary temperature in the arc tube body, it is possible to always generate the compressive stress on the arc tube body even if the arc tube is repeatedly turned on and off (or to cause the tensile stress to have a very small value even if the compressive stress and the tensile stress are alternatively generated on the arc tube body). Consequently, the junction strength of the molybdenum foil and the arc tube body can be increased. As a result, it is possible to prevent the engagement state of the molybdenum foil and the arc tube body from being broken, therefore, preventing the molybdenum foil from peeling.

In order to cause the compressive stress of $10^5$ $N/m^2$ or more to remain at the ordinary temperature in the arc tube body, moreover, it is necessary to apply a high pressure to the arc tube body, thereby carrying out the pinch seal. This high pressure generates intercrystalline cracks; that is, a plurality of cracks between grains constituting the molybdenum foil over the junction surface of the molybdenum foil and the arc tube body. The quartz glass enters the cracks so that the molybdenum foil and the arc tube body are joined with each other. Accordingly, a junction strength can be sufficiently increased.

According to the invention, therefore, it is possible to effectively suppress the generation of a leakage due to the peeling of the molybdenum foil. Consequently, the lifetime of the arc tube can be prolonged.

In the structure described above, if a ratio A/B of a width A and a thickness B in the pinch seal portion of the arc tube is set to $1.8 \leqq A/B \leqq 2.8$, a high pressure may be applied to the arc tube body during the pinch seal. Consequently, it is possible to easily cause a great compressive stress to remain in the arc tube body. The "width A of the pinch seal portion" implies a dimension in a direction parallel with the surface of the molybdenum foil and the "thickness B of the pinch seal portion" implies a dimension in a direction orthogonal to the surface of the molybdenum foil.

If an excessively high pressure is applied to the arc tube body during the pinch seal, there is a possibility of another drawback. That is, the molybdenum foil might tear. To prevent this, in one embodiment of the present invention, the elongation of the molybdenum foil generated by the pinch seal may be set to 15% or less in order to effectively suppress the generation of the foil tearing.

As described above, it is effective that a plurality of cracks (intercrystalline cracks) are generated on the junction surface of the molybdenum foil and the arc tube body in order to increase the junction strength. In this case, in one embodiment, the maximum depth of the cracks may be set to 50% of the thickness of the molybdenum foil or less in order to effectively suppress the generation of the foil tearing of the molybdenum foil. The "maximum depth of the cracks" implies the depth of one of the cracks which is formed most deeply.

DETAILED DESCRIPTION OF THE INVENTION

Figure 1:
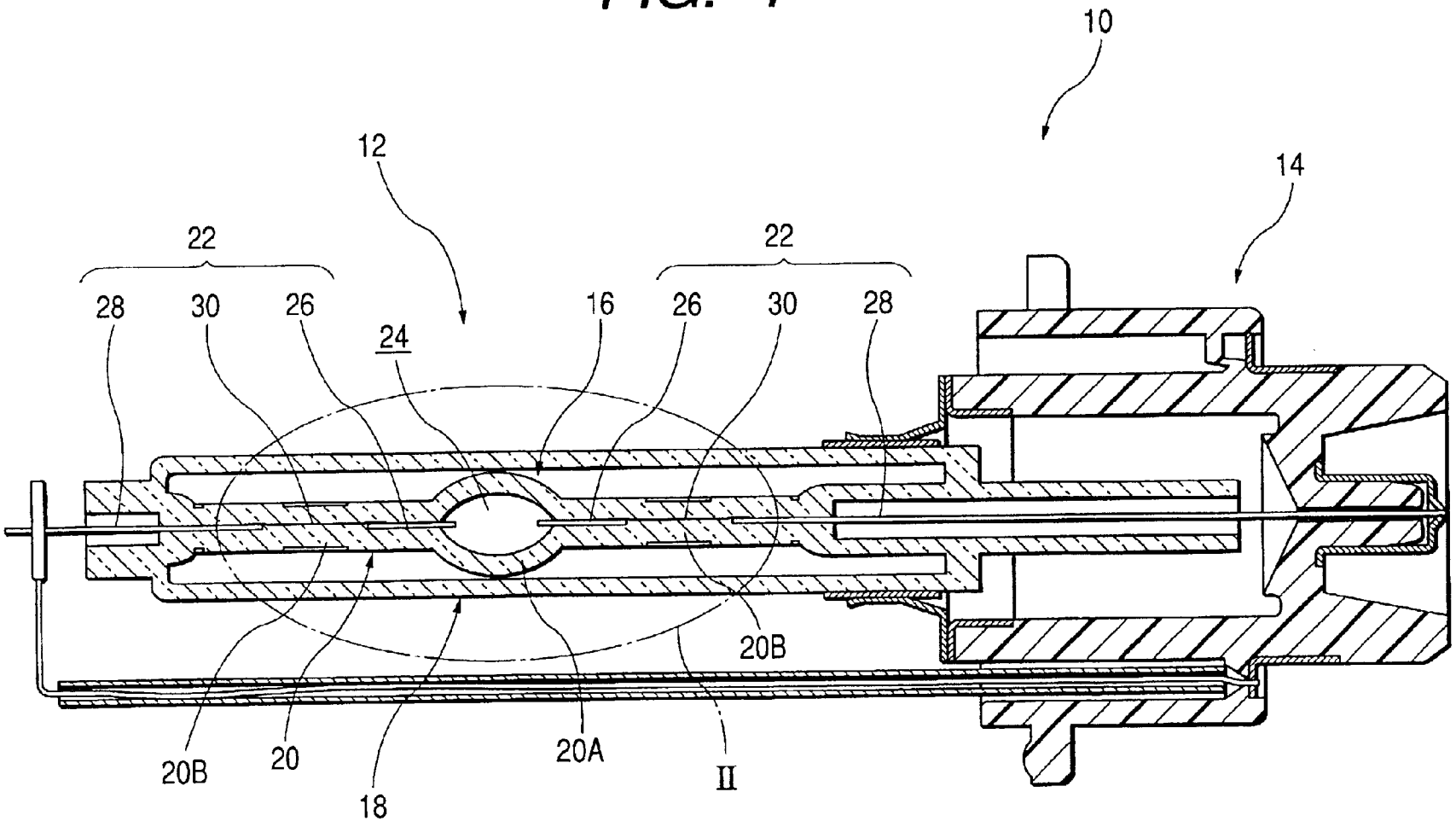
FIG. 1 is a side sectional view showing a discharge bulb having an arc tube according to an embodiment of the invention incorporated therein.
Figure 2:
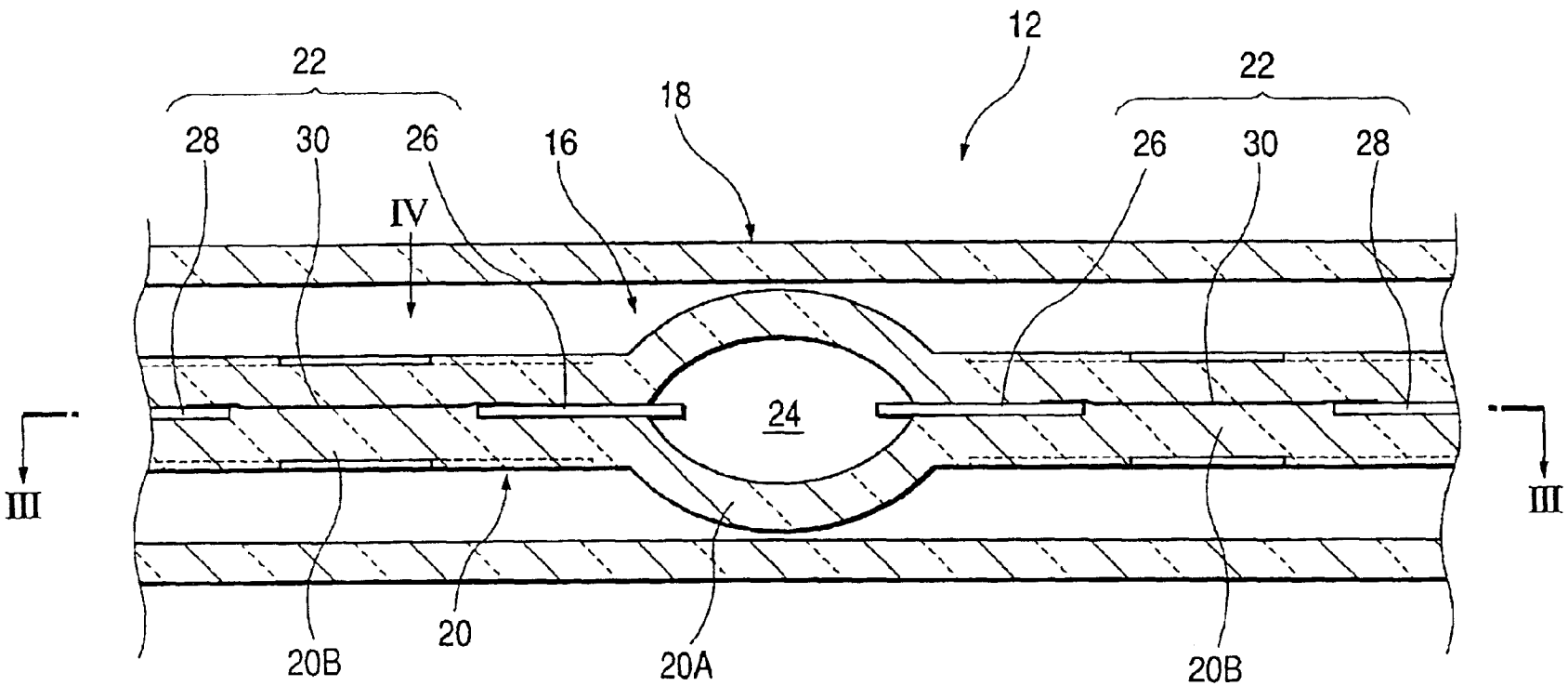
FIG. 2 is an enlarged view showing a II portion in FIG. 1.
Figure 3:
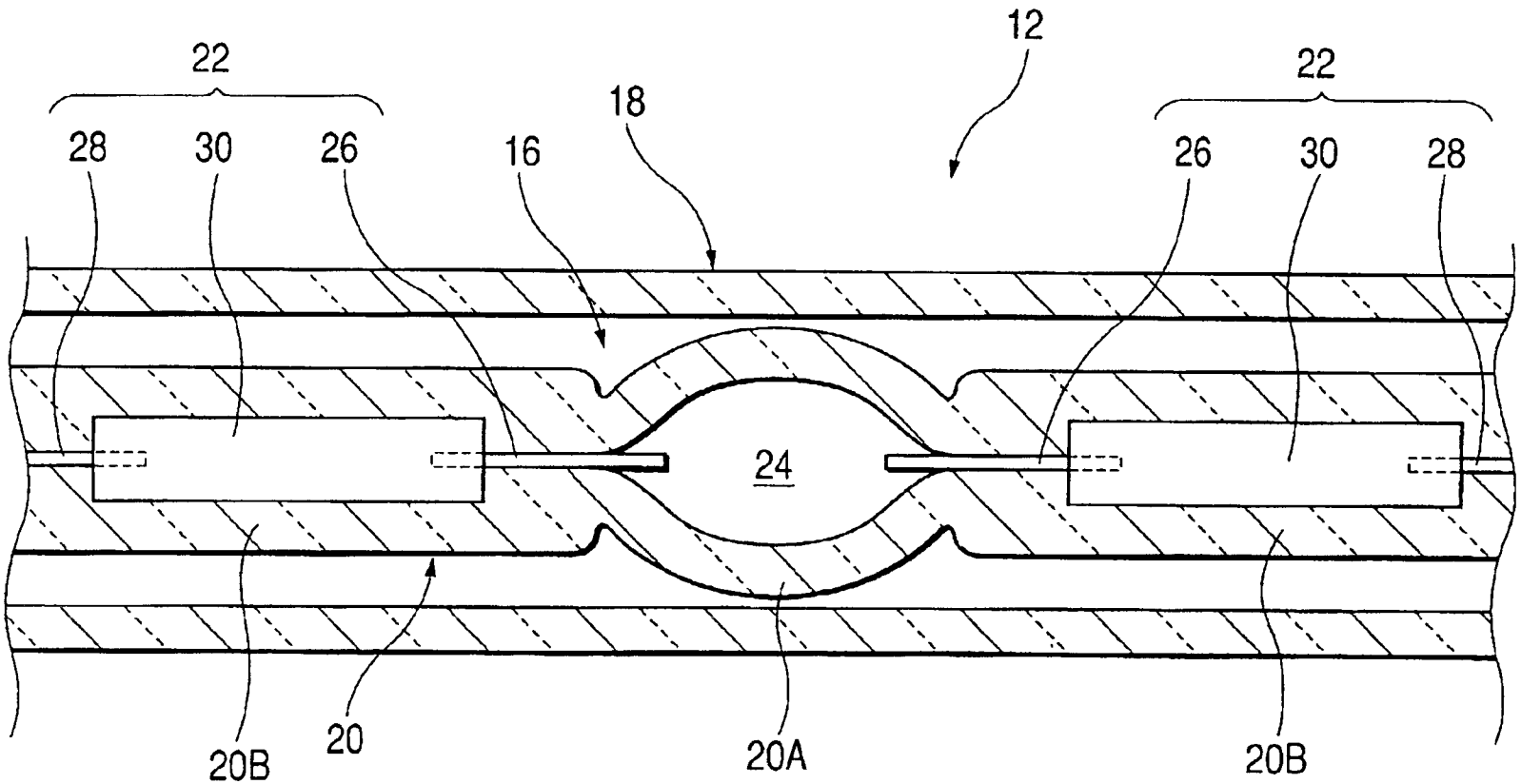
FIG. 3 is a sectional view taken along the line III—III in FIG. 2.

Embodiments of the invention will be described below with reference to the drawings. FIG. 1 is a sectional side view showing a discharge bulb 10 having an arc tube according to an embodiment of the invention incorporated therein, and FIG. 2 is an enlarged view showing a II portion in FIG. 1. FIG. 3 is a sectional view taken along the line III—III in FIG. 2.

As shown in the drawings, the discharge bulb 10 is a light source bulb to be attached to, for example, a headlamp for a vehicle and comprises an arc tube unit 12 extended in a longitudinal direction and an insulating plug unit 14 for fixing and supporting the rear end of the arc tube unit 12. The arc tube unit 12 has an arc tube 16 and a shroud tube 18 surrounding the arc tube 16. In one embodiment, the arc tube 16 and the shroud tube 18 are integrally formed.

The arc tube 16 may include an arc tube body 20 obtained by processing, for example, a quartz glass tube and a pair of longitudinal electrode assemblies 22 disposed or embedded in the arc tube body 20.

The arc tube body 20 of the embodiment of FIG. 1 includes an almost elliptic spherical light emitting tube portion 20A formed in a center of the arc tube 16, and a pinch seal portion 2B formed on both sides in front and rear portions thereof. An almost elliptic spherical discharge space 24 extended in a longitudinal direction is formed in the light emitting tube portion 20A, and mercury, a xenon gas and a metal halide may be enclosed within the discharge space 24.

In each electrode assembly 22, a bar-shaped tungsten electrode 26 and a lead wire 28 are coupled and fixed through a foil 30, such as a molybdenum foil, by welding and are pinch sealed with the arc tube body 20 in each pinch seal portion 20B. In that case, the tip portions of the respective tungsten electrodes 26 are protruded into the discharge space 24 to be opposed to each other on both longitudinal sides and portions other than the tip portions are embedded in the pinch seal portions 20B, and the whole molybdenum foil 30 may be embedded in the pinch seal portion 20B. Each molybdenum foil 30 may be obtained by doping molybdenum with yttria ($Y_2O_3$) and have, for example, a thickness of approximately 20 $\mu$m.

Figure 4:
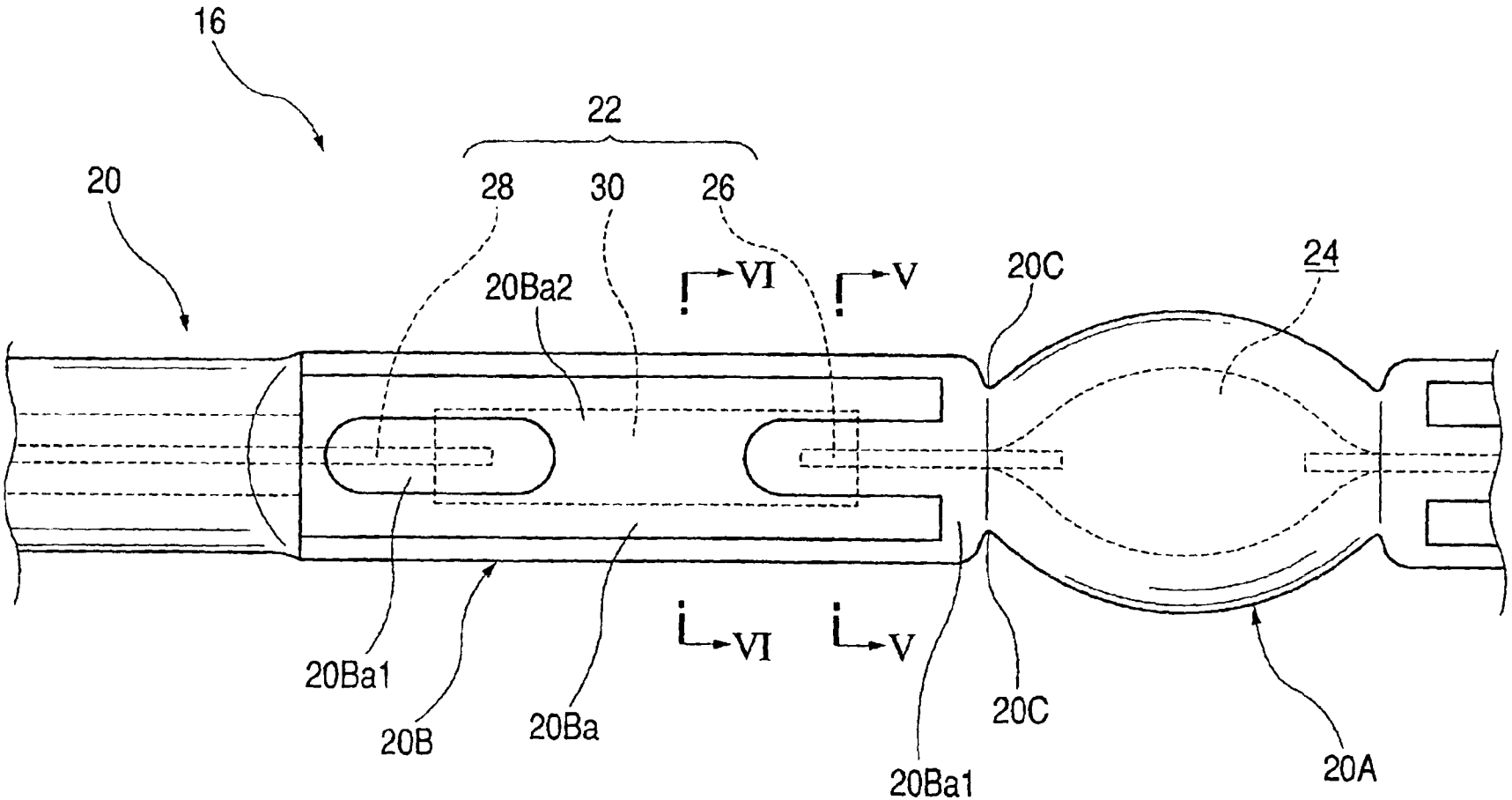
FIG. 4 is a view seen in a direction of IV in FIG. 2.
Figure 6:
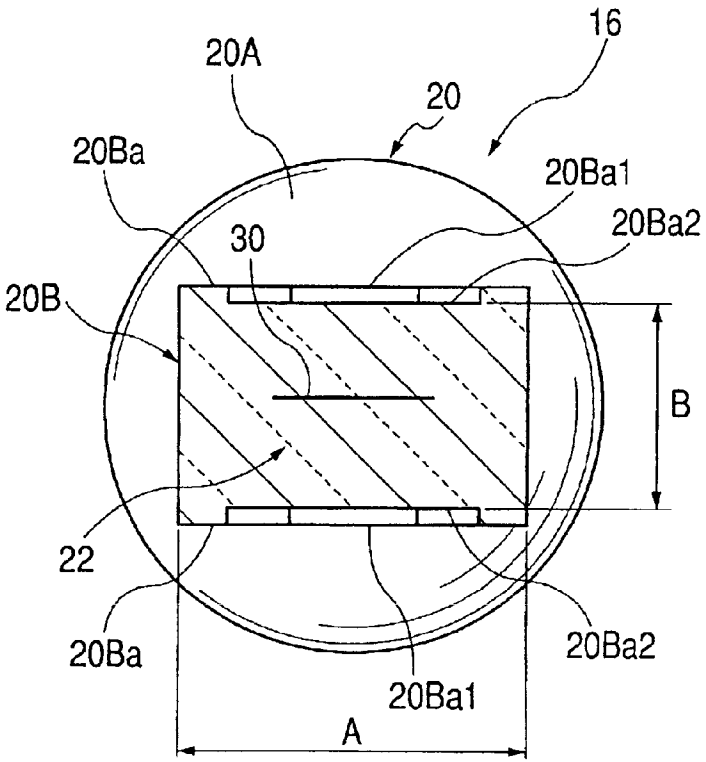
FIG. 6 is a sectional view taken along the line VI—VI in FIG. 4.
Figure 5:
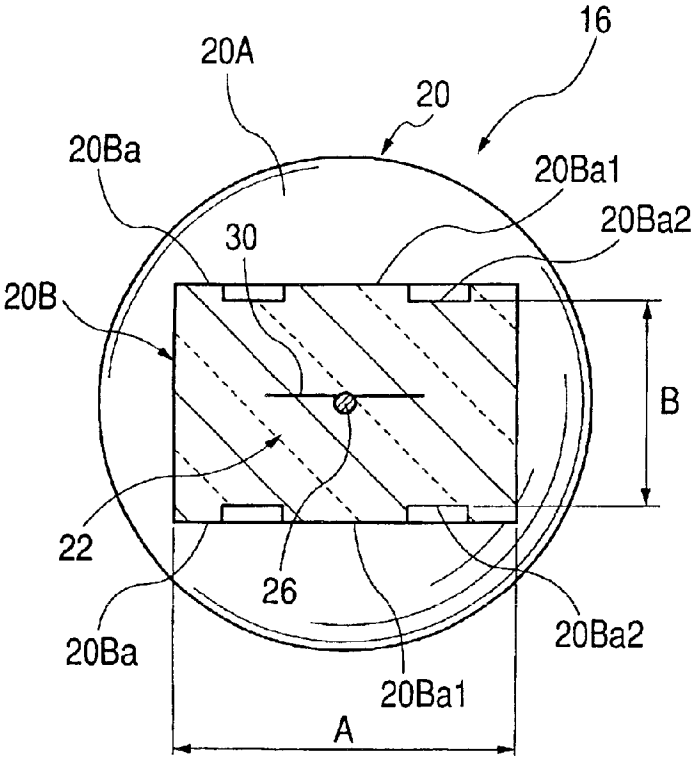
FIG. 5 is a sectional view taken along the line V—V in FIG. 4.

FIG. 4 is a view seen in a direction of IV—IV in FIG. 2, and FIGS. 5 and 6 are sectional views taken along the lines V—V and VI—VI in FIG. 4.

As shown in these drawings, the pinch seal portion 20B provided on the front side has an almost rectangular shape extended forward from the light emitting tube portion 20A seen in a plane and may be formed with a slightly larger size than that of the molybdenum foil 30. A pair of right and left neck portions 20C are formed between the pinch seal portion 20B and the light emitting tube portion 20A. Since the pinch seal portion 20B provided on the rear side has the same structure, only the pinch seal portion 20B provided on the front side will be described below.

The pinch seal portion 20B has a sectional shape that may set to be almost oblong rectangular, and both upper and lower surfaces 20Ba are constituted by general portions 20Ba1 and step-down plane portions 20Ba2 respectively.

The general portion 20Ba1 is constituted by both right and left end regions and a rear end region in each of the upper and lower surfaces 20Ba, a U-shaped region extended in a longitudinal direction including the junction portion of the molybdenum foil 30 and the tungsten electrode 26, and an oval region extended in a longitudinal direction including the junction portion of the molybdenum foil 30 and the lead wire 28, and these regions are formed to be positioned on the same plane. On the other hand, the step-down plane portion 20Ba2 includes all regions other than the general portion 20Ba1 and is formed to have a step-down planar shape with respect to the general portion 20Ba1.

The pinch seal portion 20B has a ratio A/B of a width A and a thickness B which is set to $1.8 \leqq A/B \leqq 2.8$. For example, B=1.8 to 2.2 mm (A/B=1.82 to 2.44) is set with A=4.0 to 4.4 mm. The width A represents a width dimension in a transverse direction and the thickness B represents a vertical dimension between the step-down plane portions 20Ba2 of both upper and lower surfaces 20Ba.

Figure 7:
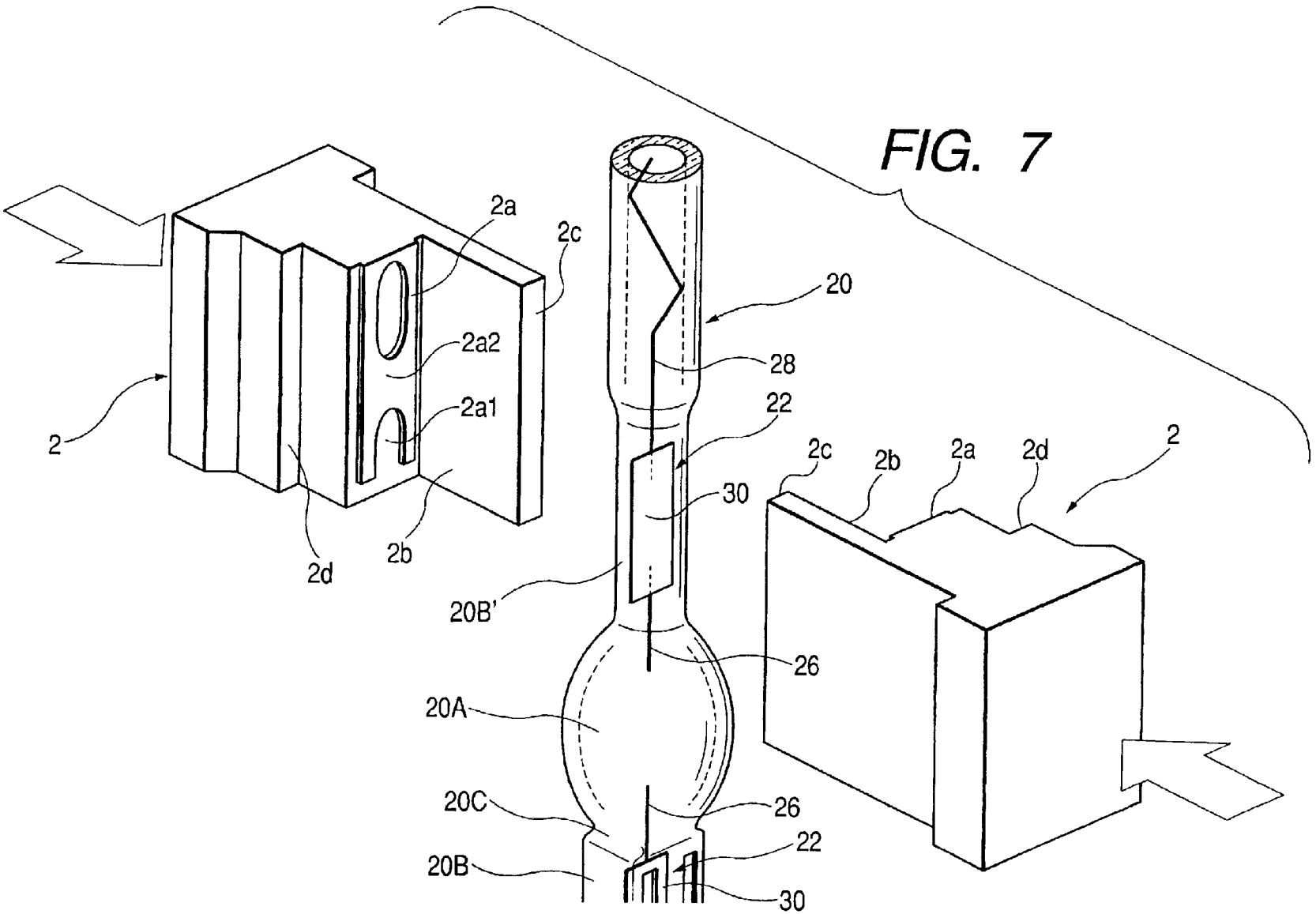
FIG. 7 is a perspective view showing the formation of a pinch seal portion on the front side of the arc tube.
Figure 8:
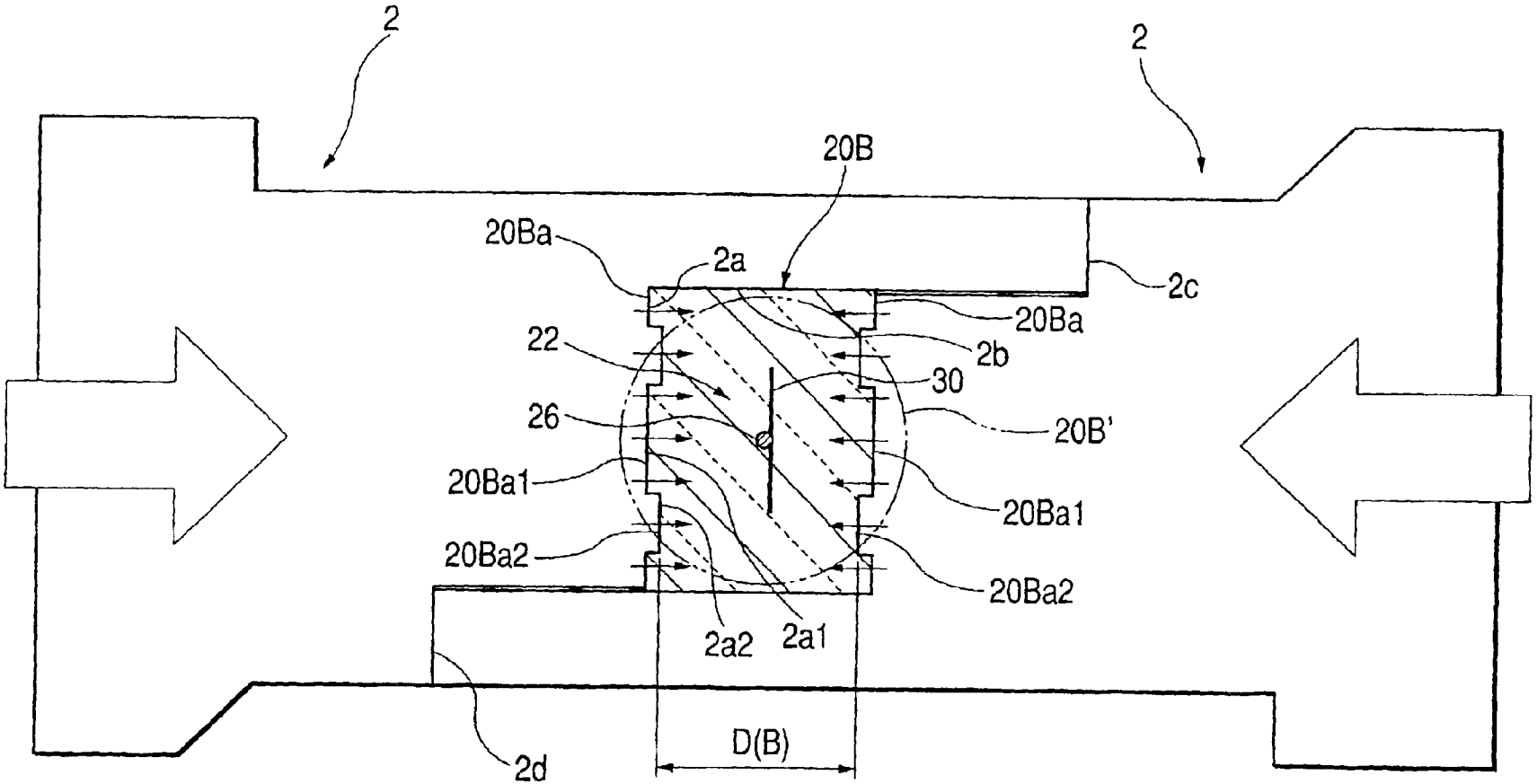
FIG. 8 is a sectional plan view showing the pinch seal formation.

FIGS. 7 and 8 are a perspective view and a sectional plan view which show the formation of a pinch seal portion 20B on the front side and a method of the invention.

As shown in FIGS. 7 and 8, at the pinch seal step, a pair of pinchers 2 are pressed against a portion 20B' to be pinch sealed which is positioned above the light emitting tube portion 20A, thereby forming the pinch seal portion 20B in such a state that the arc tube body 20 having the pinch seal portion 20B formed on the rear side is provided with a front end thereof turned upward.

Both pinchers 2 have point symmetrical structures seen in a plane. Each of the pinchers 2 is provided with a front surface portion 2*a* for forming the upper and lower surfaces 20Ba of the pinch seal portion 20B, a side surface portion 2*b* for forming both side surfaces of the pinch seal portion 20B, a stopper portion 2*c* for abutting on the other pincher during the pinch seal, and a stopper receiving portion 2*d* for receiving the stopper portion 2*c* of the other pincher. The front surface portion 2*a* of each pincher 2 is provided with a general portion 2*a*1 and a step-up plane portion 2*a*2 corresponding to the general portion 20Ba1 and the step-down plane portion 20Ba2 in each of the upper and lower surfaces 20Ba of the pinch seal portion 20B. A molding space is formed during the pinch seal by the abutment of the stopper portion 2*c* and the stopper receiving portion 2*d* in each pincher 2. At this time, the thickness B of the pinch seal portion 20B is determined by a spacing D(B) between the step-up plane portions 2*a*2 of the front surface portions 2*a* in the pinchers 2.

In order to prevent a crack from being generated due to a reduction in the thickness of the quartz glass in each junction portion of the molybdenum foil 30 and the tungsten electrode 26 and lead wire 28, the U-shaped region and the oval region may be set to be the general portion 20Ba1 in each of the upper and lower surfaces 20Ba of the pinch seal portion 20B. By setting the U-shaped region and the oval region to be the general portion 20Ba1, the direction of the electrode assembly 22 (particularly, the tip portion of the tungsten electrode 26) can be prevented from being greatly shifted in a transverse direction with respect to an axis in a longitudinal direction.

Figure 9:
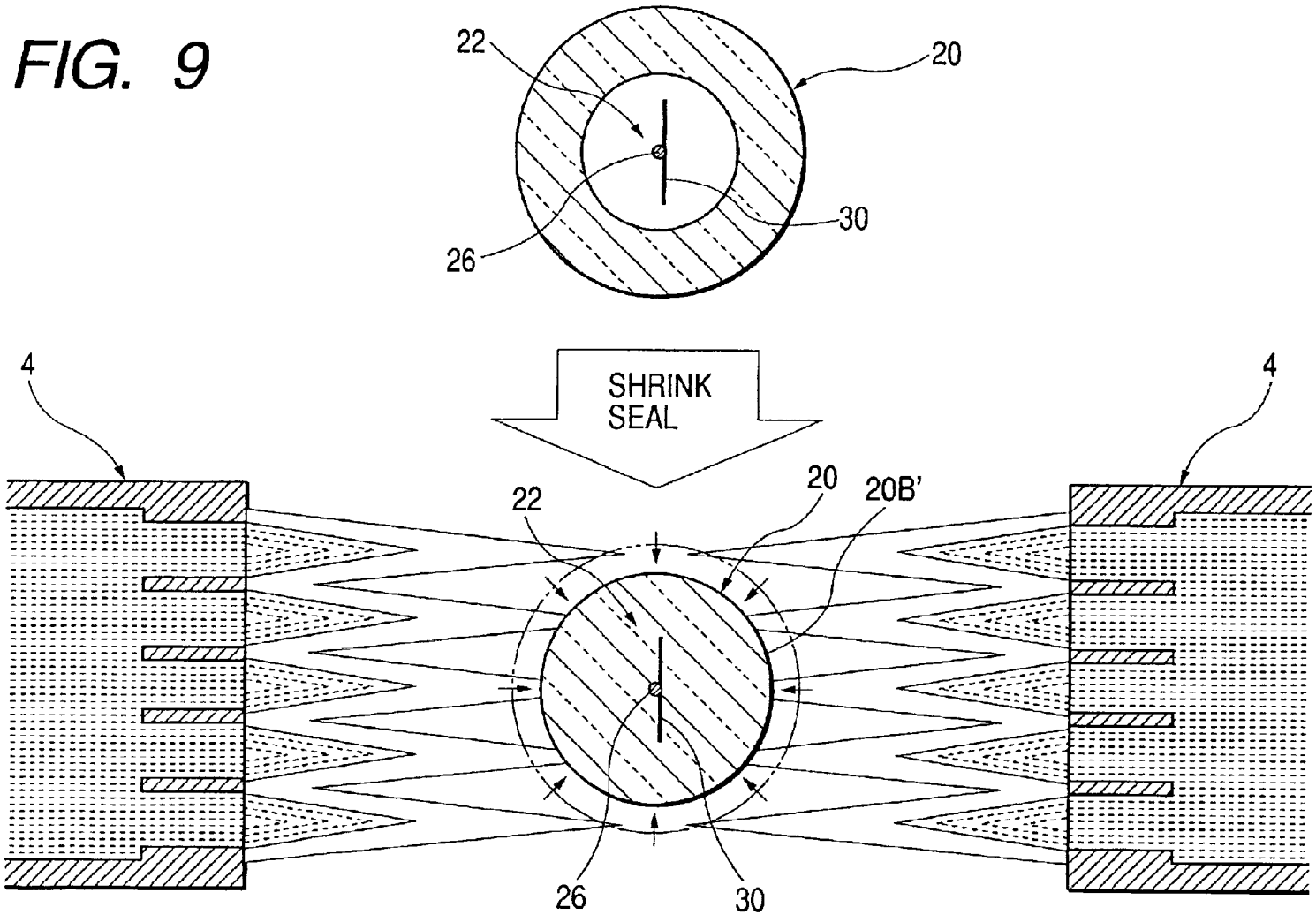
FIG. 9 is a sectional plan view showing a shrink seal process which may be carried out before the formation of the pinch seal.

The portion 20B' to be pinch sealed has a solid structure with a smaller diameter than that of a general tubular hollow portion in the arc tube body 20 and has the electrode assembly 22 positioned and embedded therein. The portion 20B' to be pinch sealed may be formed by heating the arc tube body 20 having the electrode assembly 22 inserted therein for a predetermined time by heating means, such as a pair of burners 4, on both right and left sides and thermally shrinking the arc tube body 20 over a predetermined length at a shrink seal step to be carried out before the pinch seal step as shown in FIG. 9. The heating temperature of the arc tube body 20 at the shrink seal step may be set to approximately 2000 to 2100° C. The heating temperature is set to have a value within such a range for the following reasons.

Figure 10:
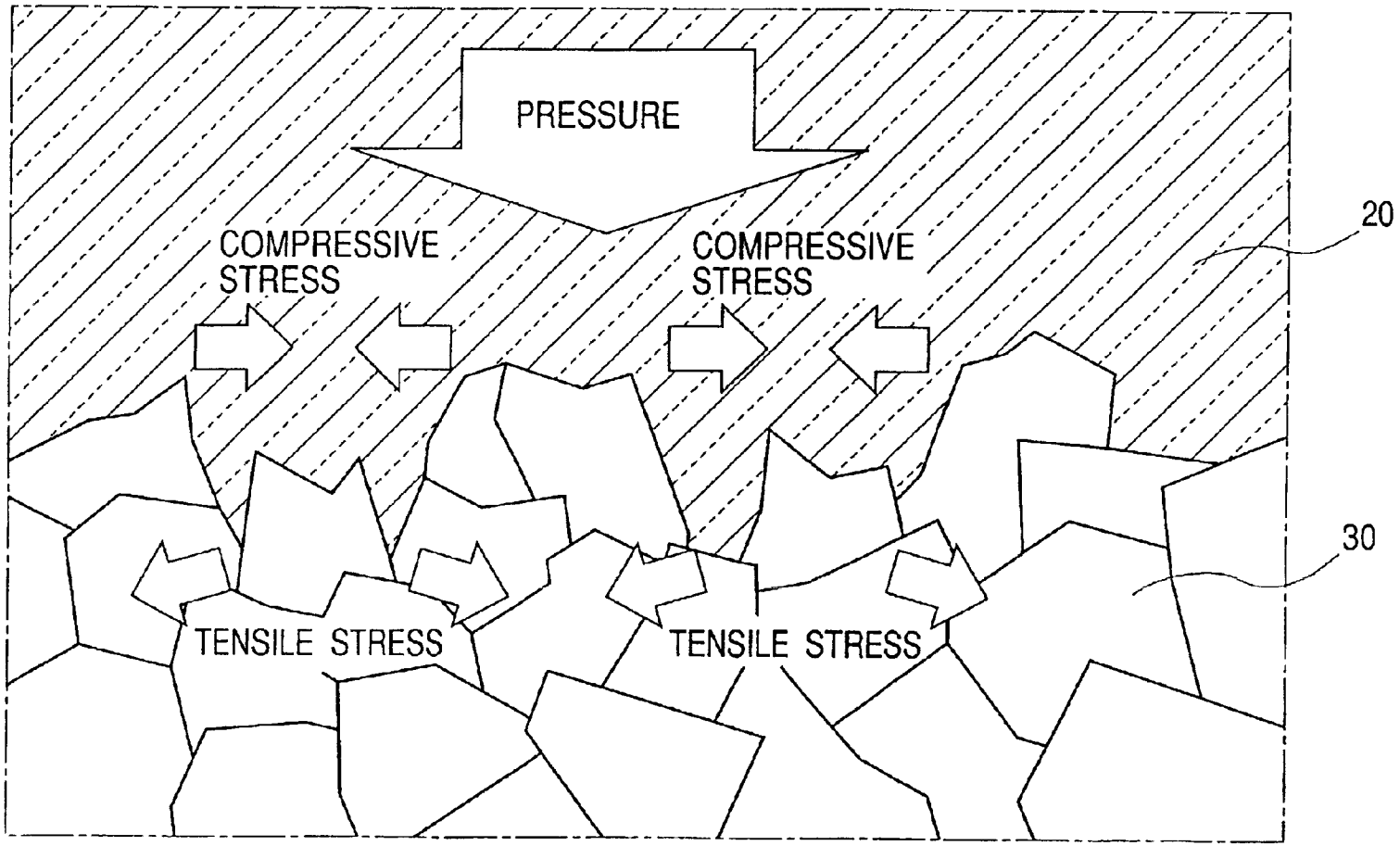
FIG. 10 is an enlarged sectional view showing the state of the junction surface of a molybdenum foil and an arc tube body in the arc tube.

More specifically, as shown in FIG. 10, the junction surface of the molybdenum foil 30 and the arc tube body 20 which are pinch sealed may be set in a state (an interlock state) in which the quartz glass constituting the arc tube body 20 flows into the concavo-convex convex surfaces of the molybdenum foil 30 and the molybdenum foil 30 is engaged with the arc tube body 20. In order to reliably obtain the engagement, it is important that the quartz glass is made to flow sufficiently. For this purpose, it is preferable that the heating temperature of the arc tube body 20 be set high, thereby reducing the viscosity of the quartz glass.

On the other hand, the molybdenum foil 30 grows recrystallized grains by heat at the shrink seal step. When the size of the recrystallized grain is increased, the engagement of the molybdenum foil 30 and the arc tube body 20 becomes insufficient. Therefore, a thermal stress is easily generated intensively on a part of the junction surface with the ON/OFF of the arc tube 16 so that the molybdenum foil 30 is peeled easily. Accordingly, in one embodiment of the invention, the heating temperature of the arc tube body 20 may be set to be low so as to suppress the growth of the recrystallized grain of the molybdenum foil 30 and a size per grain should be set to approximately 50 μm or less, thereby widely dispersing the thermal stress over the junction surface to reduce the thermal stress.

From this viewpoint, if the heating temperature of the arc tube body 20 is set to approximately 2000 to 2100° C., it is possible to sufficiently ensure the flowability of the quartz glass while maintaining the recrystallized grain in a fine condition (approximately 50 μm or less).

As shown in FIG. 10, the stress remains along the junction surface of the molybdenum foil 30 and the arc tube body 20 which are pinch sealed on both sides of the junction surface by a pressure applied to the portion 20B' to be pinch sealed during the pinch seal. More specifically, a tensile stress remains in the molybdenum foil 30 and a compressive stress remains in the arc tube body 20.

In one embodiment, the pinch seal is carried out by applying a somewhat high pressure to the portion 20B' to be pinch sealed so that a compressive stress of $10^5$ N/m$^2$ or more (for example, a compressive stress of approximately $2\times10^5$ N/m$^2$) remains at an ordinary temperature (25° C.) in the arc tube body 20. The magnitude of the residual compressive stress is determined by the spacing D(B) between the step-up plane portions 2*a*2 of the front surface portions 2*a* which is obtained with the abutment of the stopper portions 2*c* and the stopper receiving portions 2*d* in the pinchers 2. The spacing D(B) is equal to the thickness B of the pinch seal portion 20B as described above and D(B)=1.8 to 2.2 mm is set. Within such a range, the elongation of the molybdenum foil 30 which is caused by the pinch seal can be reduced to 15% or less.

Figure 11:
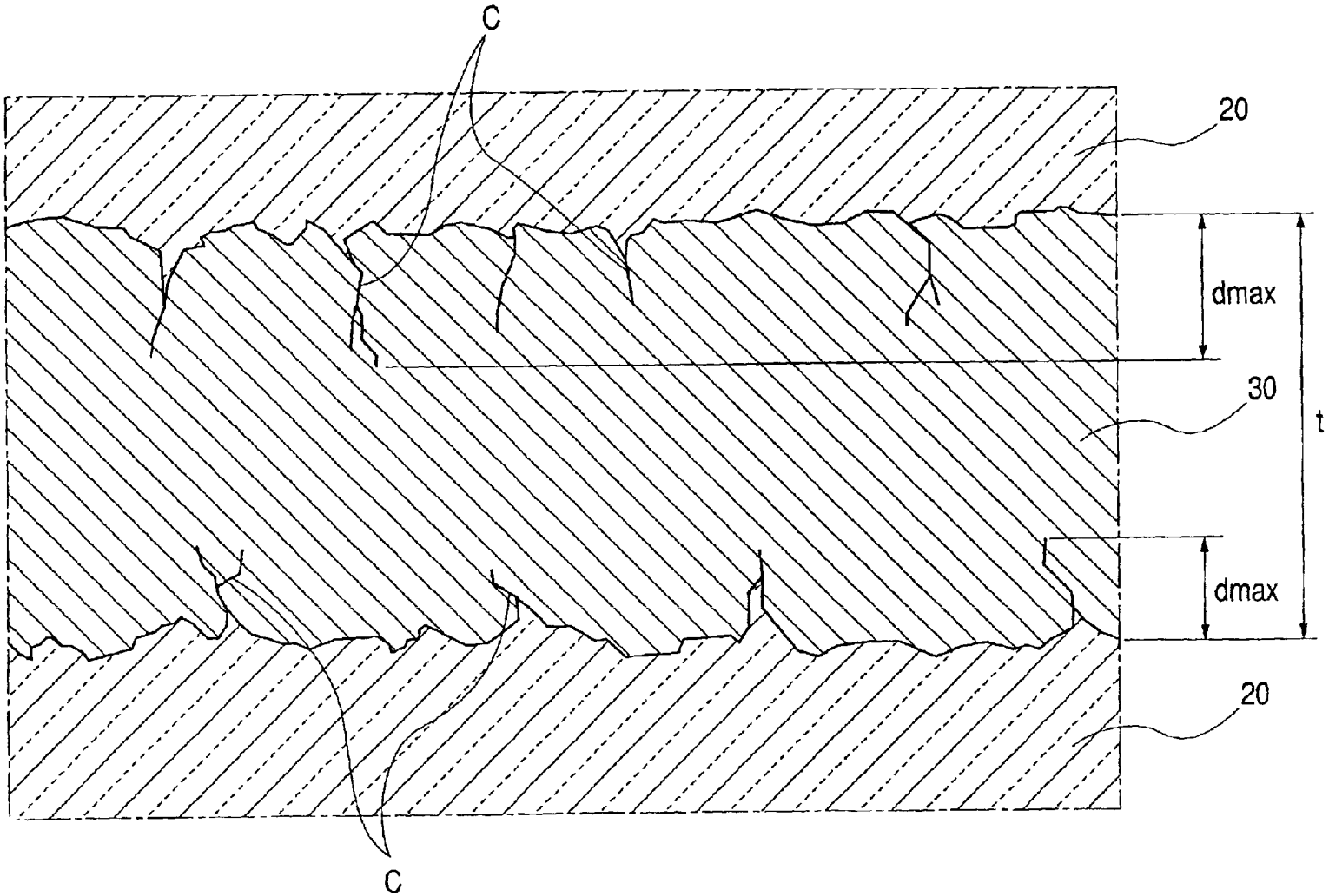
FIG. 11 is an enlarged sectional view showing the junction state of the molybdenum foil and the arc tube body in the arc tube.
Figure 12:
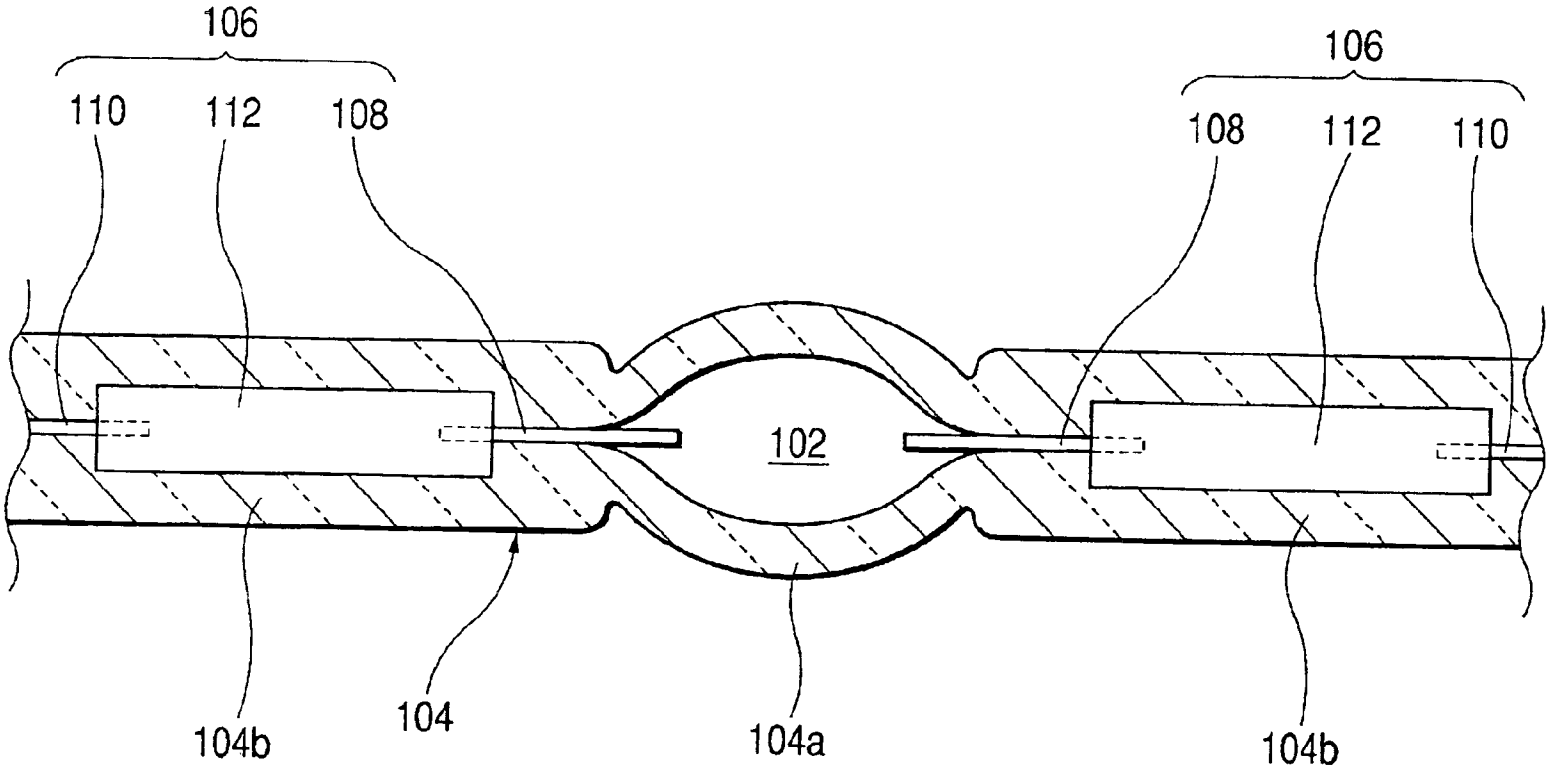
FIG. 12 is a view showing a conventional arc tube.

During the pinch seal, moreover, a high pressure is applied to the portion 20B' to be pinch sealed. In the pinch seal portion 20B thus formed, therefore, a plurality of cracks (intercrystalline cracks) C are generated on the junction surface of the molybdenum foil 30 and the arc tube body 20 as shown in FIG. 11. In one embodiment, a maximum depth (dmax) of the cracks C may be set to 50% of a thickness t of the molybdenum foil 30 or less.

As described above, the pinch seal portion 20B of an embodiment of the present invention has the ratio A/B of the width A and the thickness B set to $1.8 \leqq A/B \leqq 2.8$ for the following reasons.

When the A/B approximates to 1, the sectional shape of the pinch seal portion 20B is close to a square. During the pinch seal, therefore, the pressure of the pincher 2 acts almost uniformly on the pinch seal portion 20B in four surrounding directions. For this reason, the quartz glass flows along the pincher 2 in a vertical direction. Accordingly, the molybdenum foil 30 which is being recrystallized is easily broken to be divided vertically.

On the other hand, when the value of A/B is increased, the sectional shape of the pinch seal portion 20B becomes flat rectangular. During the pinch seal, therefore, a pressure acting on the pinch seal portion 20B in a transverse direction becomes lower than a pressure in a perpendicular direction. For this reason, the quartz glass flows along the pincher 2 in the transverse direction. Accordingly, the molybdenum foil 30 can be prevented from being broken to be divided vertically. However, if the sectional shape of the pinch seal portion 20B is too flat, the arc tube body 20 is easily broken when the pincher 2 is removed from the pinch seal portion 20B. At this time, even if the arc tube body 20 is not broken, the strength of the arc tube body 20 causes problems.

Based on the result of the following experiment, a proper range for the ratio A/B of the width A and the thickness B in the pinch seal portion 20B used in the present invention is set to $1.8 \leqq A/B \leqq 2.8$.

Table 1 below shows the result of the experimemt.

TABLE 1

Relationship between ratio of width (A) and thickness (B) in pinch seal portion and foil tearing and glass breakage (n = 10)

| A (width)/B (thickness) | 1.0 | 1.5 | 1.8 | 2.0 | 2.5 | 2.8 | 3.0 | 4.0 |
|---|---|---|---|---|---|---|---|---|
| Foil tearing | 7/10 | 3/10 | 0/10 | 0/10 | 0/10 | 0/10 | 0/10 | 0/10 |
| Glass breakage | 0/10 | 0/10 | 0/10 | 0/10 | 0/10 | 0/10 | 3/10 | 8/10 |

The experiment was carried out in order to examine the relationship between the value of A/B and the generation of foil tearing (the rupture of the molybdenum foil 30 during the pinch seal) and glass breakage (the breakage of the arc tube body 20 during the pinch seal). In the experiment, the pinch seal was carried out by setting A/B=1.0, 1.5, 1.8, 2.0, 2.5, 2.8, 3.0 and 4.0. Ten samples are given for each value of A/B.

As a result of the experiment, it is also apparent from the Table 1 that foil tearing was generated in seven samples with A/B=1.0 and in three samples with A/B=1.5 and the foil tearing was not generated at all for each value of A/B=1.8 or more. On the other hand, the glass breakage was generated in eight samples with A/B=4.0 and in three samples with A/B=3.0 and the glass breakage was not generated at all for each value with A/B=2.8 or less.

As described above in detail, in the arc tube 16 according to the present invention, the arc tube body 20 formed of quartz glass and the molybdenum foil 30 are joined through the pinch seal in such a state that the molybdenum foil 30 is inserted in the arc tube body 20. The junction is carried out such that the compressive stress of $10^5$ N/m$^2$ or more is caused to remain at the ordinary temperature in the arc tube body 20. Therefore, it is possible to always generate the compressive stress on the arc tube body 20 even if a fluctuation in the stress is generated on the junction surface by the repetition of the ON/OFF of the arc tube 16 (or to cause the tensile stress to have a very small value even if the compressive stress and the tensile stress are alternately generated on the arc tube body 20).

Also in the case of the ON/OFF of the arc tube 16, consequently, it is possible to maintain the molybdenum foil 30 and the arc tube body 20 to be engaged with each other in very small concavo-convex portions. Thus, the junction strength of both members can be increased and the molybdenum foil 30 can be prevented from being peeled easily.

In order to cause the compressive stress of $10^5$ N/m$^2$ or more to remain at the ordinary temperature in the arc tube body 20, moreover, a high pressure is applied to the arc tube body 20 to carry out the pinch seal. Therefore, a plurality of cracks C are generated on the junction surface of the molybdenum foil 30 and the arc tube body 20 by the high pressure and the quartz glass enters the cracks C so that the molybdenum foil 30 and the arc tube body 20 are joined with each other. As such, junction strength may be increased.

Therefore, it is possible to effectively suppress the generation of a leakage due to the peeling of the molybdenum foil 30. Consequently, the lifetime of the arc tube 16 can be prolonged.

In an embodiment of the present invention, the ratio A/B of the width A and the thickness B in the pinch seal portion of the arc tube 16 is set to $1.8 \leqq A/B \leqq 2.8$. Therefore, a high pressure can be applied to the arc tube body 20 without generating the foil tearing or the glass breakage during the pinch seal. Consequently, it is easy to cause a great compressive stress to remain in the arc tube body 20.

In another embodiment, moreover, the elongation of the molybdenum foil 30 which is caused by the pinch seal is set to 15% or less. Therefore, it is possible to effectively suppress the generation of the foil tearing of the molybdenum foil 30 due to the application of an excessive pressure to the arc tube body 20 during the pinch seal.

Furthermore, in an embodiment of the invention, the maximum depth ($d_{max}$) of the cracks C formed on the junction surface of the molybdenum foil 30 and the arc tube body 20 through the pinch seal may be set to 50% or less of the thickness t of the molybdenum foil. Therefore, the quartz glass can enter the cracks C to increase the junction strength of the molybdenum foil 30 and the arc tube body 20, thereby effectively suppressing the generation of the foil tearing of the molybdenum foil 30.

While the arc tube 16 of the discharge bulb 10 to be attached to a headlamp for a vehicle has been described in the embodiments above, the same functions and effects as those in the embodiments can be obtained by employing the same structure as described above for arc tubes to be used for other purposes.

What is claimed is:

1. An arc tube comprising:

an arc tube body; and a foil joined with the arc tube body by pinch seal, the arc tube body having a compressive stress of $10^5$ N/m$^2$ or more along a junction surface with the foil at an ordinary temperature, said arc tube body containing quartz glass, wherein a ratio A/B of a width A and a thickness B in a pinch seal portion of the arc tube is $1.8 \leqq A/B \leqq 2.8$.

2. The arc tube according to claim 1, wherein the foil has a pre-pinch seal dimension before being joined with the arc tube body by pinch seal, and the pre-pinch seal dimension is elongated no more than 15% after being joined with the arc tube body by pinch seal.

3. The arc tube according to claim 1, further including a plurality of cracks formed on the junction surface of the foil and the arc tube body, wherein a maximum depth of the cracks is 50% or less of a thickness of the molybdenum foil.

4. The arc tube according to claim 2, further including a plurality of cracks formed on the junction surface of the foil and the arc tube body, wherein a maximum depth of the cracks is 50% or less of a thickness of the molybdenum foil.

5. The arc tube according to claim 1, wherein the foil contains molybdenum.

6. The arc tube according to claim 1, wherein:

the junction surface is roughened; and a plurality of cracks extend from the junction surface substantially into a thickness of the molybdenum foil, up to a maximum depth of approximately 50% of said thickness.

7. The arc tube according to claim 2, wherein:

the junction surface is roughened; and a plurality of cracks extend from the junction surface substantially into a thickness of the molybdenum foil, up to a maximum depth of approximately 50% of said thickness.

* * * * *